US005305725A

United States Patent [19]

Marlow

[11] Patent Number: 5,305,725

[45] Date of Patent: Apr. 26, 1994

[54] METHOD AND APPARATUS FOR TREATING FUEL

[76] Inventor: John R. Marlow, 4316 E. Tropicana Ave., #89, Las Vegas, Nev. 89121

[21] Appl. No.: 943,469

[22] Filed: Sep. 11, 1992

[51] Int. Cl.[5] ..... F02M 33/00

[52] U.S. Cl. ..... 123/538; 431/2

[58] Field of Search ..... 123/536, 537, 538, 539, 123/557, 577, 3; 431/2

[56] References Cited

U.S. PATENT DOCUMENTS

| | | | |
|---|---|---|---|
| 4,111,636 | 9/1978 | Goldberg | 431/2 |
| 4,125,090 | 11/1978 | Masunaga et al. | 123/537 |
| 4,303,051 | 12/1981 | Weishar | 123/3 |
| 4,354,475 | 10/1982 | O'Toole et al. | 123/577 |
| 4,715,325 | 12/1987 | Walker | 123/538 |
| 4,798,191 | 1/1989 | King | 123/557 |
| 4,930,483 | 6/1990 | Jones | 123/538 |
| 5,074,273 | 12/1991 | Brown | 123/537 |
| 5,154,153 | 10/1992 | MacGregor | 123/538 |

*Primary Examiner*—Tony M. Argenbright
*Assistant Examiner*—M. Macy
*Attorney, Agent, or Firm*—Tod R. Nissle

[57] ABSTRACT

A method and apparatus for treating fuel contacts fuel with metals having standard reduction potentials of differing polarity. The metals are work hardened to produce slip bands and stria at the surface of the metals.

8 Claims, 1 Drawing Sheet

FIG. 1
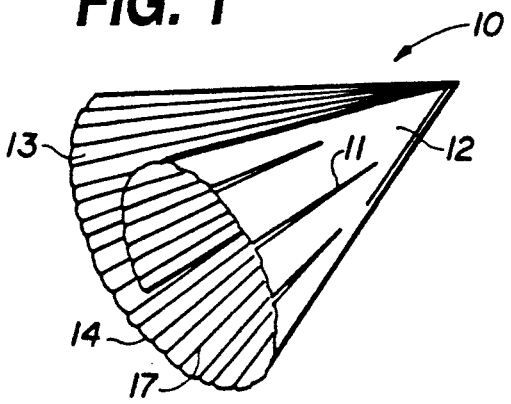
FIG. 2
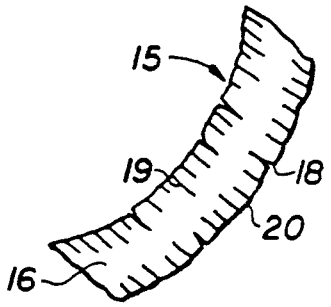
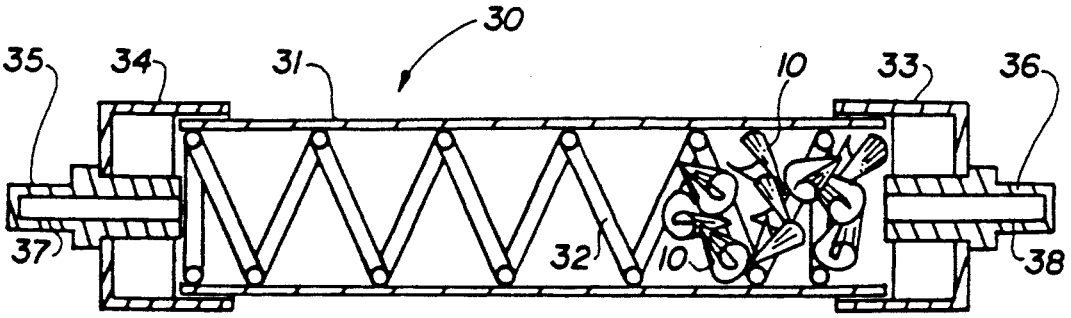
FIG. 3

METHOD AND APPARATUS FOR TREATING FUEL

This invention relates to a method and apparatus for treating fuel to improve the combustion characteristics of the fuel.

More particularly, the invention relates to a method and apparatus for treating hydrocarbon fuel by contacting the fuel with metals having standard reduction potentials of differing polarity.

In a further respect, the invention relates to a method and apparatus for treating hydrocarbon fuel with work hardened metals having slip bands which produce stria at the surface of the metals.

Carbon monoxide, hydrocarbons, and other combustion by-products produced by an automobile engine cause large scale air pollution in most industrialized countries in the world. Means have long been sought to reduce the quantity of pollutants produced by each gallon of fuel which is consumed.

In accordance with the invention, I have discovered a new method and apparatus which improves the combustion properties of hydrocarbon fuels to minimize the quantity of carbon monoxides and hydrocarbon pollutants which are generated during combustion of the fuels and which maximizes the mileage achieved by a vehicle utilizing the fuel. My apparatus includes at least one primary member, at least one secondary member contacting the primary member, and means for contacting the primary member and the secondary member with hydrocarbon fuel. The primary member has a surface including at least one metal having a standard reduction potential at 298.15K and at a pressure of 101.325 kPa which is more positive than that of the standard hydrogen electrode. The secondary member has a surface including at least one metal having a standard reduction potential at 298.15K and at a pressure of 101.325 kPa which is more negative than that of the standard hydrogen electrode. The differential between the standard reduction potential of the metal in the primary member and the metal in the secondary member is at least 0.47 volts.

In another embodiment of the invention, I provide a method of promoting the efficient combustion of hydrocarbon fuel. The method includes the step of contacting a primary member and a secondary member with the hydrocarbon fuel. The primary member has a surface including at least one metal having a standard reduction potential at 298.15K and at a pressure of 101.325 kPa which is more positive than that of the standard hydrogen electrode. The secondary member has a surface including at least one metal having a standard reduction potential at 298.15K and at a pressure of 101.325 kPa which is more negative than that of the standard hydrogen electrode. The surface of the secondary member is at least partially covered by a coating comprised of at least 40% by weight silver or ruthenium. The primary member can comprise a metal other than silver and be at least partially covered by a coating comprised of at least 40% by weight silver or ruthenium.

In a further embodiment of the invention, I provide a device for promoting the efficient combustion of hydrocarbon fuel. The device includes at least one primary member, at least one work hardened metal shaving, and means for contacting the primary member and metal shaving with the hydrocarbon fuel. The primary member has a surface including at least one metal. The metal shaving includes a plurality of slip bands and is formed by the deformation of an existing piece of metal to produce the metal shaving. The shaving contacts the surface of the primary member.

As used herein the term metals and metal elements include lithium and beryllium in the first short period of the periodic table, sodium, magnesium and aluminum in the second short period, the thirteen elements from potassium to gallium in the first long period, the fourteen from rubidium to tin in the second long period, the twenty-nine from cesium to bismuth in the first very long period (including the fourteen rare-earth metals), as well as the eighteen from francium to churchatovium. Boron, silicon, and germanium are metalloids, with properties intermediate between those of metal and those of nonmetals.

The metal or metals in the primary member, secondary member, and metal shavings can comprise alloys or, when possible, metals in their elemental form.

The work hardened metal shavings are presently preferably formed by cutting the shavings from an existing piece of metal, and comprise curls or arcuate pieces of metal. The shavings can, however, take on any shape and dimension and can be produced by any desirable means including using projectiles or other means to tear or break away pieces of metal from an existing piece of metal. Work hardened shavings can also be produced by taking an existing piece of metal and work hardening the metal by bending or deforming the metal. Any desirable means can be used to bend and work harden the piece of metal. For example, the piece of metal can be manually grasped and bent, can be impinged or projected against a surface to bend the metal, etc. When work hardened metal shavings are formed, the metal undergoes plastic deformation and slip bands are ordinarily formed in the metal. Fractures can also be formed during work hardening of the metal. When arcuate shavings or curls are cut or peeled from an existing piece of metal using a lathe, one side or surf ace (the outer or convex side) of the shavings typically is rather smooth and shiny whilst the other side or surface (the inner or concave side) is comparatively rough and has surf ace stria and irregularities produced as the result of the slip bands which result during plastic deformation of the metal. The cold worked curls can also have small fracture lines extending inwardly from the edge or surfaces of the curls. Using in the invention cold worked shavings with surface stria, fractures, and/or irregularities significantly increases the effectiveness of the invention.

As utilized herein, the term "combustion characteristics" includes but is not limited to the compression produced by the fuel in the combustion chambers of an engine, the RPM of the engine produced by combustion of the fuel, the ppm of carbon monoxide, hydrocarbons, and other combustion by-products in the exhaust of the engine; and, the miles per gallon achieved using the fuel. The combustion characteristics of a fuel indicate the efficiency and completeness with which a fuel burns and indicate the power produced or work achieved by the apparatus using the fuel. The combustion characteristics of a fuel are improved when the fuel produces smaller quantities of carbon monoxide and other exhaust by-products, when the miles per gallon achieved with the fuel increases, when the engine compression increases, when the engine RPM increases, etc.

Apparatus utilized in the practice of the invention is illustrated in the drawings, in which:

FIG. 1 is a perspective view illustrating a shaving or curl used in the method and apparatus of the invention;

FIG. 2 is a perspective view illustrating another curl used in the method and apparatus of the invention; and, FIG. 3 is a side section view illustrating a fuel treatment cartridge constructed in accordance with the invention to house the shavings or curls of FIGS. 1 and 2.

Turning now to the drawings, which depict the presently preferred embodiments of the apparatus of the invention for the purpose of illustrating the practice thereof and not by way of limitation of the scope of the invention, and in which like reference characters refer to corresponding elements throughout the several views, FIG. 1 illustrates a shaving or curl generally indicated by reference character 10. Shaving 10 is cut from an existing piece of brass, bronze, or other metal with a lathe. The outer convex surface 12 of shaving 10 is formed and shaving 10 "curls" as the lathe peels shaving 10 off of the existing piece of metal. Surface 12 is formed by and slides over the cutting edge of the lathe. Surface 12 is, although scalloped and buckled, relatively smooth and shiny. The inner concave contact surface 13 is relatively striated 17 and rough due to the slip bands and fracture lines 11 formed at the surface during the cutting and cold working of metal to form shaving 10. Some of the fracture lines 11 are visible to the naked eye.

In FIG. 2, shaving 15 includes outer convex surface 20 which is, although buckled or scalloped, relatively smooth and shiny. The inner concave surface 16 is relatively rough and includes stria 19. Some of the fracture line 18 are visible to the naked eye.

The fuel treatment cartridge 30 of FIG. 3 includes hollow cylindrical tube or housing 31. Helical primary member 32 is carried in housing 31 along with shavings or secondary members 10. Shavings 10 ordinarily fill the interior of housing 31. In FIG. 3, housing 31 is, for the sake of clarity, only shown partially filled with shavings 10. Primary member 32 presently includes at least one metal, like iron, which has a standard reduction potential, Eo, at 298.15K (25 degrees C.) and at a pressure of 101.325 kPa (one atmosphere) which is more negative than that of the standard hydrogen electrode. For example, in one embodiment of the invention, primary member 32 comprises galvanized chicken wire (iron and zinc). Secondary members 10 presently include at least one metal, like copper, which has a standard reduction potential, Eo, at 298.15K (25 degrees C.) and at a pressure of 101.325 kPa (one atmosphere) which is more positive than that of the standard hydrogen electrode. In another embodiment of the invention, secondary members 10 comprise brass or bronze while primary member 32 comprises zinc. There can be one or more secondary member 10 and one or more primary member 32. Cylindrical caps 33 and 34 cover and seal the open ends of cylindrical housing or tube 30. Caps 33 and 34 can fit inside or outside of the ends of tube 30 or otherwise be shaped and dimensioned for attachment to tube 30. Cylindrical nipples 36 and 35 are secured in and extend through caps 33 and 34, respectively. Nipples 36 and 35 can, if desired be integrally formed as a part of caps 33 and 34. Hydrocarbon fuel flows into housing 31 through aperture 38 in nipple 36, flows through and contacts housing 31, member 32, and shavings 10, and exits housing 31 through aperture 37 formed in nipple 35. Cartridge 30 ordinarily is installed in the fuel line such that fuel traveling to the internal combustion engine of an automobile or other vehicle passes from the fuel line into cartridge through nipple 36, travels through housing 31, exits cartridge 30 and flows back into the fuel line through nipple, 35, and travels through the fuel line to the engine.

If desired, instead of using primary member 32, housing 31 can be fabricated from iron or any other desired metal which serves the function of primary member 32. The inner surface of housing 31 can be plated or otherwise coated with a selected metal. For example, if housing 31 is fabricated from iron, the inner surface of housing 31 can be coated with zinc so that the inner surface of housing 31 would contact members 10 and housing 31 would perform the function normally performed by member 32.

As would be appreciated by those of skill in the art, secondary members 10 can comprise iron or some other metal member having a standard reduction potential which is more positive than that of the standard hydrogen electrode while member(s) 32 can comprise copper or some other metal member having a standard reduction potential which is more negative than that of the standard hydrogen electrode.

Regardless of whether member 32 (or housing 31) simply comprises iron or iron coated with zinc, I have discovered that coating member 32 with silver and/or ruthenium further increases the effectiveness of the fuel treatment cartridge of the invention. Coating members 10 with silver also improves the effectiveness of the invention. This result was somewhat unexpected because a premise of the invention which appeared to be important in furthering the combustion characteristics of fuel was that the more negative (or positive) the standard reduction potential of member 32 and the more positive (or negative) the standard reduction potential of members 10, then the more effective the invention was in improving the combustion characteristics of hydrocarbon fuel. Coating, however, a galvanized iron or steel member 32 with silver and/or ruthenium improved the functioning of the invention when shavings 10 included a metal like copper having a positive standard reduction potential in comparison to that of the standard hydrogen electrode. This was a surprising result because the standard reduction potential of silver and ruthenium is positive while the standard reduction potential of iron or steel is negative. Coating shavings 10 with silver and/or ruthenium also furthers the performance of the invention when the shavings 10 are bronze, brass, or copper.

The use in member 32 of metals having a standard reduction potential polarity, i.e., having a positive or negative standard reduction potential with respect to the standard hydrogen electrode, which is opposite that of the metal or metals in members 10 is central to the practice of the invention. Consequently, if metals like zinc and iron with a negative polarity are used in member 32, then it is desirable to use metals like copper which have a positive polarity in members 10. The standard electrode reduction potentials of some metals are shown below in Table I.

TABLE I

STANDARD REDUCTION POTENTIALS, Eo VALUES, AT 298.15K (25 degrees C) AND AT A PRESSURE OF 101.325 Kpa (1 atm.)

| Metal Potential | Ion | Half Reaction | Electrode (Volt) |
|---|---|---|---|
| Lithium | Li+ | Li = Li+ + e− | −3.05 |
| Potassium | K+ | K = K+ + e− | −2.92 |
| Barium | Ba2+ | Ba = Ba2+ + 2e− | −2.90 |

TABLE I-continued

STANDARD REDUCTION POTENTIALS, Eo VALUES, AT 298.15K (25 degrees C) AND AT A PRESSURE OF 101.325 Kpa (1 atm.)

| Metal Potential | Ion | Half Reaction | Electrode (Volt) |
|---|---|---|---|
| Calcium | Ca2+ | Ca = Ca2+ + 2e− | −2.87 |
| Sodium | Na+ | Na = Na+ + e− | −2.71 |
| Magnesium | Mg2+ | Mg = Mg2+ + 2e− | −2.37 |
| Aluminum | A13+ | Al = A13+ + 3e− | −1.66 |
| Zinc | Zn2+ | Zn = Zn2+ + 2e− | −0.76 |
| Iron | Re2+ | Fe = Fe2+ = 2e− | −0.44 |
| Cadmium | Cd2+ | Cd = Cd2+ + 2e− | −0.40 |
| Nickel | Ni2+ | Ni = Ni2+ + 2e− | −0.25 |
| Tin | Sn2+ | Sn = Sn2+ + 2e− | −0.14 |
| Lead | Pb2+ | Pb = Pb2+ + 2e− | −0.13 |
| Hydrogen | H+ | H2 = 2H+ + 2e− | 0.00 |
| Copper | Cu2+ | Cu = Cu2+ + 2e− | +0.34 |
| Ruthenium | Ru2+ | Ru = Ru2+ + 2e− | +0.46 |
| Mercury | Hg2+ | 2Hg = Hg22+ + 2e− | +0.79 |
| Silver | Ag+ | Ag = Ag+ + e− | +0.80 |
| Palladium | Pd2+ | Pd = Pd2+ + 2e− | +0.95 |
| Platinum | Pt2+ | Pt = Pt2+ + 2e− | +1.20 |
| Gold | Au3+ | Au = Au3+ + 3e− | +1.49 |
| Steel (hot rolled, cold rolled, low carbon, high carbon) | | | about −0.25 |
| 60–40 brass | | | about +0.30 |
| 60–40 brass coated with 0.01 mil layer of silver | | | about +0.45 |
| Zinc coated with 0.01 mil layer of silver | | | about −0.85 |

The following examples are presented, not by way of limitation of the scope of the invention, but to illustrate to those skilled in the art, the practice of various of the presently preferred embodiments of the invention and to distinguish the invention from the prior art.

EXAMPLE 1

The fuel treatment cartridge 30 of FIG. 3 was constructed, except that galvanized chicken wire was wound into a three layer cylinder and substituted for member 32. The work hardened shavings 10 were cut from a common foundry brass and included about 10.0% by weight nickel, 0.25% by weight iron, 64.5% by weight copper, 24.65% percent by weight zinc, 0.10% by weight lead, and 0.50% by weight manganese.

The cartridge 30 was integrated in the fuel line of a 1979 Dodge Diplomat automobile having an odometer reading of 84,868 miles. The automobile had an eight cylinder gasoline engine. Consequently, fuel traveling from the gasoline tank to the engine traveled through the cartridge 30 and moved over and contacts the galvanized wire and shavings 10.

Before, however, cartridge 30 was integrated in the fuel line of the automobile, the average RPM at idle, the average compression at initial crank, the average compression at 2500 RPM, the average carbon monoxide emission in ppm at 2500 RPM, the average hydrocarbon (HC) emissions in ppm at 2500 RPM, and the average miles per gallon were determined when eighty-seven octane normal unleaded gasoline was used as fuel. Several tanks of gasoline were used to drive the automobile about 700 miles. The amount of fuel consumed was divided into 700 to determine the miles per gallon. Readings for the RPM at idle, the compression at initial crank, the compression at 2500 RPM, the carbon monoxide emissions as a percent of exhaust at 2500 RPM, and the hydrocarbon (HC) emissions in ppm at 2500 RPM were taken each time the gas tank in the automobile was filled and the automobile was conditioned. The automobile was conditioned by being driven in all manner of conditions including both highway and city operation, after which the readings were taken. The readings were averaged.

The fuel treatment cartridge 30 was installed immediately after the automobile had been driven 700 miles to determine the average miles per gallon achieved by driving the automobile on normal eighty-seven octane unleaded gasoline. After cartridge 30 was integrated in the fuel line, the automobile was driven 100 miles utilizing ordinary eighty-seven octane unleaded gasoline. After the automobile was driven 100 miles, several more tanks of eighty-seven octane gasoline were consumed and the automobile was driven an additional 800 miles. Readings for the RPM at idle, the compression at initial crank, the compression at 2500 RPM, the carbon dioxide (CO) emission in percent of exhaust at 2500 RPM, and the hydrocarbon emissions in ppm at 2500 RPM were taken each time the gas tank in the automobile was filled while the automobile was driven an additional 800 miles (in addition to the 700 and 100 miles segments previously driven). The readings obtained were averaged. The average miles per gallon of fuel is determined by dividing 800 by the gallons of fuel consumed. The below TABLE II summarizes the various readings obtained before and after cartridge 30 is integrated in the fuel line of the truck.

TABLE II

| | RPM at Idle | Average Compression at Initial Crank | Average Compression at 250 RPM | CO Emissions as % of exhaust at 2500 RPM |
|---|---|---|---|---|
| Without Cartridge 30 Installed In Fuel Line | 685 | 92 | 163 | 1.3 |
| With Cartridge 30 Installed In Fuel Line | 790 | 119 | 197 | 0.4 |

| | Hydrocarbon Emissions in PPM at 2500 RPM | Miles per Gallon |
|---|---|---|
| Without Cartridge 30 Installed In Fuel Line | 163 | 8.9 |
| With Cartridge 30 Installed In Fuel Line | 71 | 10.3 |

Note: Each value in TABLE II with exception of Miles per Gallon values is an average of three or more readings each taken after a new tank of unleaded gasoline was put into the automobile.

After cartridge 30 was integrated in the fuel line, the automobile engine started more quickly and had increased power and acceleration.

EXAMPLE 2

A cartridge 30 is integrated in the fuel line of a ten wheel diesel tractor—truck which pulls a moving van or other large trailer. Consequently, fuel traveling from the diesel fuel tank to the engine travels through the cartridge 30 and moves over and contacts the galvanized wire and shavings 10. Before cartridge 30 is installed in the fuel tank of the truck, the average stack temperature of the truck at idle, the peak horsepower at 1800 RPM, the average smoke opacity at maximum acceleration, the average smoke opacity at 1800 horsepower, and the average radiator fluid temperature are determined. The average miles per gallon is determined by driving the truck about 700 miles and dividing the 700 miles by the quantity of fuel consumed. The temperature of fluid in the radiator is determined by taking several readings after the truck is driven for about an hour at fifty miles per hour. The stack temperature, peak horsepower at 1800 RPM, smoke opacity at maximum acceleration, smoke opacity at peak horsepower are also determined by taking several readings after the truck is driven for about an hour. The stack temperature is determined by placing a pyrometer one inch away from and centered on the exhaust end of the stack of the truck. The fuel treatment cartridge 30 is installed in the fuel line of the truck immediately after the truck is driven 700 miles to determine the average miles per gallon achieved by driving the truck on diesel fuel and to take the measurements referred to above. When cartridge 30 is installed in the fuel line of the truck, fuel drawn from the tank passes through cartridge 30 before traveling to the truck engine.

After cartridge 30 is installed in the fuel tank, the truck is driven 600 miles utilizing No. 2 diesel fuel. After the truck is driven 600 miles the truck is driven an additional 800 miles and readings are taken for the stack temperature at idle, the peak engine horsepower at 1800 RPM, the smoke opacity at maximum acceleration, the smoke opacity at peak horsepower, and the temperature of fluid in the radiator. Several readings are taken for the stack temperature at idle, the peak engine horsepower at 1800 RPM, the smoke opacity at maximum acceleration, the smoke opacity at peak horsepower, and the temperature of fluid in the radiator and the average of the readings is obtained. The below TABLE III summarizes the various readings obtained before and after cartridge 30 is integrated in the fuel line of the truck.

TABLE III

| of | Stack Temperature at Idle (Degrees F) | Peak H.P. at 1800 RPM | Smoke Opacity at Max Acceleration | Smoke Opacity at Peak Horsepower | Temperature Radiator Fluid (Degrees F) |
|---|---|---|---|---|---|
| Without Cartridge 30 Installed In Fuel Tank | 121 | 352 | 33 | 16 | 189 |
| With Cartridge 30 Installed In Fuel Tank | 107 | 383 | 14 | 5 | 184 |

The Joint TMC/SAE Fuel Consumption Test Procedures—Type II are applied and reveal that when unit 30 is installed in the fuel line of a truck, a fuel saving improvement of from 2.6% to 6.2% is realized in comparison to the fuel consumption of the truck during the 600 miles prior to the installation of cartridge 30 in the fuel line of the truck.

EXAMPLE 3

EXAMPLE 1 is repeated, except that the wire is coated with a 0.01 mil thick layer of silver. Similar results are obtained, except that the gasoline mileage increases an additional 1.1 mpg over the increases obtained in EXAMPLE 1 and the hydrocarbon emissions are further reduced by an additional 15 to 16 PPM (to about 56 PPM) over the reduction obtained in EXAMPLE 1.

EXAMPLE 4

EXAMPLE 1 is repeated, except that the wire and the shavings 10 are each coated with a 0.01 mil thick layer of silver. Similar results are obtained, except that the gasoline mileage increases an additional 1.1 mpg over the increases obtained in EXAMPLE 1 and the hydrocarbon emissions are further reduced by an additional 6 to 8 PPM (to about 49 PPM) over the reduction obtained in EXAMPLE 1.

EXAMPLE 5

EXAMPLE 1 is repeated, except that the wire is coated with a 0.01 mil thick layer of an alloy comprised of 90% by weight silver and 10% by weight copper. Similar results are obtained.

EXAMPLE 6

EXAMPLE 1 is repeated, except that the wire and the shavings 10 are each coated with a 0.01 mil thick layer of an alloy comprised of 90% by weight silver and 10% by weight copper. Similar results are obtained.

EXAMPLE 7

EXAMPLE 1 is repeated, except that the wire is coated with a 0.01 mil thick layer of an alloy comprised of 40% by weight silver, 40% by weight tin, 14% by weight copper, and 6% by weight zinc. Similar results are obtained.

EXAMPLE 8

EXAMPLE 1 is repeated, except that the wire and the shavings 10 are each coated with a 0.01 mil thick layer of an alloy comprised of 40% by weight tin, 14% by weight copper, and 6% by weight zinc. Similar results are obtained.

EXAMPLE 9

EXAMPLE 1 is repeated, except that the wire is coated with a 0.01 mil thick layer of ruthenium. Similar results are obtained, except that the gasoline mileage increases an additional 1.1 mpg over the increases obtained in EXAMPLE 1 and the hydrocarbon emissions are further reduced by an additional 15 to 16 PPM (to about 56 PPM) over the reduction obtained in EXAMPLE 1.

EXAMPLE 10

EXAMPLE 1 is repeated, except that the wire and the shavings 10 are each coated with a 0.01 mil thick layer of ruthenium. Similar results are obtained, except that the gasoline mileage increases an additional 1.1 mpg over the increases obtained in EXAMPLE 1 and the hydrocarbon emissions are further reduced by an additional 6 to 8 PPM (to about 49 PPM) over the reduction obtained in EXAMPLE 1.

EXAMPLE 11

EXAMPLE 1 is repeated, except that the wire is coated with a 0.01 mil thick layer of an alloy comprised of 90% by weight ruthenium and 10% by weight platinum. Similar results are obtained.

EXAMPLE 12

EXAMPLE 1 is repeated, except that the wire and the shavings 10 are each coated with a 0.01 mil thick layer of an alloy comprised of 90% by weight ruthenium and 10% by weight platinum. Similar results are obtained.

EXAMPLE 13

EXAMPLE 1 is repeated, except that the wire is coated with a 0.01 mil thick layer of an alloy comprised of 40% by weight ruthenium, 40% by weight tin, 14% by weight copper, and 6% by weight zinc. Similar results are obtained.

EXAMPLE 14

EXAMPLE 1 is repeated, except that the wire and the shavings 10 are each coated with a 0.01 mil thick layer of an alloy comprised of 40% by weight ruthenium, 40% by weight tin, 14% by weight copper, and 6% by weight zinc. Similar results are obtained.

EXAMPLE 15

EXAMPLE 1 is repeated except that shavings 10 are cut from a bronze comprises of 88% by weight copper, 10% by weight tin, and 2% by weight zinc. Similar results are obtained.

EXAMPLE 16

EXAMPLE 1 is repeated except that the galvanized wire is replaced with wire made from zinc. Similar results are obtained.

EXAMPLE 17

EXAMPLE 1 is repeated except that the galvanized wire is replaced with wire made from nickel. Similar results are obtained.

EXAMPLE 18

EXAMPLE 1 is repeated except that the shavings 10 are cut from ruthenium. Similar results are obtained.

EXAMPLE 19

EXAMPLE 1 is repeated except that the shavings 10 are cut from silver. Similar results are obtained.

Having described my invention in such terms as to enable those skilled in the art to understand and practice it, and having identified the presently preferred embodiments thereof, I claim:

1. A device for promoting the efficient combustion of fluid hydrocarbon fuel comprising (a) at least one primary metal member comprised of at least one metal selected from the group consisting of brass, copper, and bronze, said primary metal member coated with at least one metal selected from the group consisting of silver and silver alloys;

(b) at least one secondary metal member comprised of at least one metal, said secondary metal member contacting said primary metal member; and, (c) means for contacting said primary metal member and said secondary metal member with the hydrocarbon fuel;

said secondary metal member having a standard reduction potential, Eo, at 298.15K and a pressure of 101.325 kPa which is more negative than that of the standard hydrogen electrode; the differential between the standard reduction potential, Eo, of said primary metal member and said secondary metal member being at least 0.46 volts.

2. The device of claim 1 wherein said secondary metal member is comprised of at least one metal selected from a group consisting of zinc, magnesium, manganese and coated with at least one metal from a group consisting of silver and silver alloys.

3. The device of claim 2 wherein said secondary metal member is a work hardened metal shaving including a plurality of slip bands and formed by plastic deformation of an existing piece of metal to produce said metal shaving.

4. The device of claim 1 wherein said primary metal member is a work hardened metal shaving including a plurality of slip bands and formed by plastic deformation of an existing piece of metal to produce said metal shaving.

5. A device for promoting the efficient combustion of fluid hydrocarbon fuel comprising (a) at least one primary metal member;

(b) at least one secondary metal member comprised of at least one metal selected from a group consisting of zinc, magnesium, and manganese coated with at least one metal from a group consisting of silver and a silver alloy; and, (c) means for contacting said primary metal member and said secondary metal member with the hydrocarbon fuel;

said primary metal member having a standard reduction potential, Eo, at 298.15K (25 degrees C.) at a pressure of 101.325 kPa (one atmosphere) which is more positive than that of the standard hydrogen electrode; the differential between the standard reduction potential, Eo, of said primary metal member and said secondary metal member being at least 0.46 volts.

6. The device of claim 5 wherein said primary metal member is comprised of at least one metal selected from a group consisting of zinc, magnesium, and manganese and is coated by at least one metal selected from a group consisting of silver and silver alloys.

7. The device of claim 6 wherein said primary metal member is a work hardened metal shaving including a plurality of slip bands and formed by plastic deformation of an existing piece of metal to produce said metal shaving.

8. The device of claim 5 wherein said secondary metal member is a work hardened metal shaving including a plurality of slip bands and formed by plastic deformation of an existing piece of metal to produce said metal shaving.

* * * * *